United States Patent [19]

Greiner et al.

[11] Patent Number: 4,553,478

[45] Date of Patent: Nov. 19, 1985

[54] PRINTING MACHINE PRE-SETTING ARRANGEMENT

[75] Inventors: Harry M. Greiner, Offenbach am Main; Hermann Fischer, Augsburg; Claus Simeth, Offenbach am Main, all of Fed. Rep. of Germany

[73] Assignee: M.A.N.-Roland Druckmaschinen Aktiengesellschaft, Fed. Rep. of Germany

[21] Appl. No.: 572,693

[22] Filed: Jan. 20, 1984

[30] Foreign Application Priority Data

Jan. 28, 1983 [DE] Fed. Rep. of Germany ..... 3302798

[51] Int. Cl.[4] ..... B41F 5/06; B41F 5/16

[52] U.S. Cl. ..... 101/426; 101/181; 101/248

[58] Field of Search ..... 101/248, 181, 350, 365, 101/DIG. 24, DIG. 26; 250/559, 561, 571; 226/2, 28, 29–31; 364/469, 560, 561, 562

[56] References Cited

U.S. PATENT DOCUMENTS

| | | | |
|---|---|---|---|
| 3,701,464 | 10/1972 | Crum | 226/3 |
| 3,841,215 | 10/1974 | Hasegawa | 101/350 X |
| 3,958,509 | 5/1976 | Murray et al. | 101/365 X |
| 4,135,664 | 1/1979 | Resh | 235/475 |
| 4,200,932 | 4/1980 | Schramm et al. | 364/519 |
| 4,233,663 | 11/1980 | Sugawara et al. | 101/170 X |
| 4,318,176 | 3/1982 | Stratton et al. | 364/469 |
| 4,428,287 | 1/1984 | Greiner | 101/350 |
| 4,437,403 | 3/1984 | Greiner | 101/248 |

*Primary Examiner*—J. Reed Fisher

*Attorney, Agent, or Firm*—Leydig, Voit & Mayer, Ltd.

[57] ABSTRACT

A system for presetting register and color zone adjusting devices in a multi-color rotary printing machine uses digitally-driven optical scanners axially traversing the plate cylinders under control of at least one numerical computer. Machine-specific characteristics are programmed in non-volatile memory as referenced values. Data processing is not required to be conducted external to the printing machine. The system is compact and requires practically no re-adjustment or entry of desired values from the machine operator. The machine operator, however, may enter coordinates for printing areas on the printing plate in order to speed up the scanning process for determining the initial color zone preset. The scanner multi-functionally scans the printing plate for both register adjustment and for integrating the ratio of printing to non-printing area for each inking zone. The system is easily reprogrammed and the optical scanner is interchangeable with a densitometer in order to provide alternative control functions during printing, such as the regulation of inking and dampening.

14 Claims, 19 Drawing Figures

PRINTING MACHINE PRE-SETTING ARRANGEMENT

BACKGROUND OF THE INVENTION

This invention relates to computerized controls for printing machines, and more particularly to a presetting apparatus for register and color zone adjustment.

At the present time, the major printing machine manufacturers sell computerized printing machine control systems for remote control of ink-dosing elements arranged across the width of the printing machine for applying ink to printing plates, and for remote control of circumferential, axial, and in some cases diagonal or skew register of the printing plates. The adjustments, for example, are entered by an operator at a remote control terminal. Such a system may be provided with a densitometer table for scanning color control strips printed on a test sheet for automatic control of ink density, as is described in Schramm et al. U.S. Pat. No. 4,200,932 issued Apr. 29, 1980 and for which a reexamination certificate issued Apr. 26, 1983.

Computerized press controls have been used for real time and continuous register adjustment for web-fed rotary printing machines. See, for example, Stratton et al. U.S. Pat. No. 4,318,176 issued Mar. 2, 1982. Typically, web registration control systems have optical sensors focused upon axial and skew register marks printed on the web, and may also have an optical sensor detecting an axial or skew reference mark engraved on the plate cylinder. See, for example, Resh U.S. Pat. No. 4,135,664 issued Jan. 23, 1979, and Crum U.S. Pat. No. 3,701,464 issued Oct. 31, 1972.

It is known to scan a printing plate or original print at a location remote from the printing press to estimate the necessary amount of ink for printing or to predetermine appropriate settings for ink dosing keys. Sugawara et al. U.S. Pat. No. 4,233,663 issued Nov. 11, 1980 discloses a system wherein an original print is mounted on a drum and is scanned by an optical sensor. The signal from the optical sensor is processed digitally and the digital signals are classified into 256 levels so that the accumulated value for each level may be adjusted by an individual correction factor representing the amount of ink required to print a picture dot at the corresponding optical density level, before integrating to determine the total amount of ink required to print all the picture dots on the original print. A slightly different system is disclosed in Murray et al. U.S. Pat. No. 3,958,509 issued May 25, 1976 wherein a flat lithographic plate is scanned by a television camera and after normalization, the signal is accumulated or integrated over the inking zones on the printing plate to determine appropriate settings for the ink keys.

The assignee of the present invention has endeavored to develop automatic register control systems for sheet-fed rotary printing machines. Greiner U.S. Pat. No. 4,437,403 issued Mar. 20, 1984 discloses an automatic control method and apparatus for adjusting the register of printing plates in a multi-color printing press before test sheets or proofs are printed. Photoelectric scanners sense right-angle register marks engraved on the printing plates and determine the relative positions of the printing plates without the use of paper. Greiner U.S. Pat. No. 4,428,287 issued Jan. 31, 1984 discloses an apparatus and method for checking and automatically correcting register adjustment of a sheet-fed printing press at the same time as remote densitometeric measurement of an ink density check strip printed on a test sheet for ink fountain key adjustment. Alignment marks printed on the test sheet parallel to the ink density check strip are sensed by a second optical sensor mounted alongside the densitometer which reads the ink density check strip.

The references cited above are only a few of the diverse systems and methods that have been devised for presetting ink dosing and plate register. In general, these methods require measured values to be fed to intermediate memories, and another operation or remote control system is required to transmit adjustments to the ink dosing devices and register adjustment mechanisms. But these various methods are complex and suffer reliability problems due to the number of individual components which may fail. Also, the resulting accuracy of the pre-setting operation is not very high. It is fair to say, however, that remote control systems have evolved to such an extent that the mechanical parts of the printing press subject to adjustment can be automatically adjusted in response to the input of desired values. German Pat. No. 2,922,964, for example, discloses a system for preparing and controlling printing presses including the pre-setting and further adjustment of the inking unit, ink guide, and dampening and folding units.

SUMMARY OF THE INVENTION

The primary object of the invention is provide a highly reliable system for reducing the setting-up time on a rotary printing machine.

Another object of the invention is to provide a presetting system for a rotary printing machine which requires a minimum input of desired values from the operator.

A specific object of the invention is to provide operator entry of coordinates for printing areas on the printing plate in order to speed up the scanning process for determining initial ink dosing presets.

Still another specific object of the invention is to provide a system which does not require data processing external to the printing machine.

A further object of the invention is to provide a presetting system which uses components interchangeable with run-time inking and dampening control system components.

In accordance with an important aspect of the invention, an optical scanner scans a printing plate clamped to a plate cylinder multi-functionally under numerical control so that register presets and ink zone presets are directly adjustable inside the printing machine.

The optical scanner is digitally-driving axially with respect to the plate cylinder by the numerical control computer. Using digital signal processing, the optical scanner can both detect the positions of register marks and can also determine the ratio of printing to non-printing zones on the printing plate from which the ink-dosing presets are calculated by the numerical control computer.

Since the optical scanner and numerical control computer are built into the printing machine, the measurements are dependent upon and uniquely associated with the particular machine. The machine-dependent parameters such as offset errors and ink zone locations are stored in non-volatile memory in the numerical control computer so that the operator need not input them into the control system. This results in a considerable savings of time in the pre-setting operation. Also, there is no need to pull a proof or test sheet and examine it for the pre-setting operation, since the printing plate used in the machine is scanned directly. The printing plate is not inked either before or during the measurement, and the optical sensor need not be specially calibrated since the signal from the optical scanner is processed digitally.

By driving the optical scanner across the width of the printing plate, the operator is given a yes/no decision whether the presetting operation has been accomplished. From the operator's viewpoint, there is no technically complicated survey of the printing plate.

Depending upon the sensitivity or speed of the measurements, the plate cylinder may rotate intermittently or continuously at a specific speed. Measuring speed, however, can be selected at a high rate to give a fast preset at low resolution, or slowed down to use the full resolution of the optical sensor. Preferably, the register marks are selected in a size such as to give optimum conventional presetting at conventional printing speeds of rotation of the plate cylinder. Register marks in the form of conventional crosses and light/dark zones are used.

According to the preferred procedure for performing the presetting operations, the register presetting is carried out first followed by the ink dosing or color zone presetting. Preferably diagonal or skew, circumferential or peripheral, and lateral or axial register are all measured and then adjusted to eliminate deviations from the desired register adjustment. The numerical control computer compares the measured positions of the register marks to desired positions and generates appropriate control signals fed to the register adjusting devices.

After the register pre-setting has been carried out, the difference in shading between the printing and non-printing areas of the printing plate are measured multifunctionally to provide optimum adjustment of the ink dosing or color zone devices. The printing plate on the plate cylinder is scanned either axially or circumferentially. In the circumferential scanning method, the plate cylinder rotates continuously, for example at the maximum possible speed, while the scanner steps axially to traverse the individual color zones or else carries out just small traversing operations corresponding to the color zone width. In the axial scanning method, the optical scanner traverses axially at a relatively high speed, preferably both in a forward and reverse direction, while the plate cylinder rotates slowly or intermittently. In either case the optical measurements are integrated circumferentially for each inking zone.

Preferably a keyboard or other means are provided for operator entry of coordinates of printing areas or zones on the printing plate and the speed of the optical scanner is responsive to the positions of the printing areas on the printing plate. Preferably the scanner uses a fine adjustment or slow speed to traverse the printing areas, but a course step or high speed for those zones in which there is no printed matter or other information on the printing plate.

Preferably the numerical control unit knows the precise axial and circumferential coordinates of the printing plate being observed by the optical scanner at any point in time. The scanner is mounted on a traversing mechanism parallel to the plate cylinder axis. Preferably the traversing mechanism is of the kind used in plotting machines. The traversing mechanism, for example, uses a cable with lateral rollers and stepping motors so that the traversing mechanism can be incorporated compactly in any size of printing machine simply by cutting the traversing rail or cross-member to the required length.

Preferably the circumferential coordinate of the location observed by the scanner is precisely determined by a high precision digital angle resolver. In addition to providing the circumferential coordinates or radial division of the plate cylinder, the angle resolver provides a signal for controlling all cyclic or speed-dependent functions of the printing machine, such as front edge sensing, pressure adjustment, gripper blocking, vibrator control, and powder sprinkling.

In accordance with another aspect of the present invention, the optical scanner is mounted interchangeably on the traversing mechanism by means of a bayonet mount. The bayonet mount preferably has an electrical interlock so that the printing machine cannot start unless an optical sensor is mounted. Optionally, a number of mounts may be provided for a plurality of optical sensors to reduce measurement time. It is advantageous to use a bayonet mount which also accepts a densitometer interchangeable with the optical scanner, for sensing ink and dampening solution during continuous printing. In other words, after the presetting operation has been accomplished and just before continuous printing is to take place, the optical sensor is replaced with a densitometer responsive to the actual thickness of ink and dampening solution applied to the printing plate.

Preferably the presetting system is entirely digital so that is highly reliable and may be reprogrammed to suit particular applications or to perform multiple functions. When the optical scanner is replaced with the optical densitometer, for example, the numerical control computer executes a program for continuous regulation of the ink to dampening solution ratio. Preferably the numerical control program is stored in non-volatile memory since it is associated with a particular machine and there is no need for the operator to change that program once the program is installed. The volatile memory locations in the numerical computer, however, are eraseable after each presetting operation so that they may be used by other numerical control programs. The numerical control computer, the traversing mechanism and the resolver, are easily converted or reprogramed to perform other functions besides presetting operations.

The numerical control computer operates adjustment devices directly without intermediate intervention by the operator. Thus, there is no confusion as to which machine adjustments are to be transferred or directed. Hence, measuring and adjusting time is considerably reduced. Measurements and corrections are easily repeated until the measured values are in agreement with desired values.

BRIEF DESCRIPTION OF THE DRAWINGS

Other objects and advantages of the present invention will become apparent upon reading the following detailed description and upon reference to the drawings in which.

While the invention will be described in connection with a preferred embodiment, it will be understood that there is no intention to limit the invention to the construction shown, but the intention is, on the contrary, to cover the various alternative and equivalent constructions included within the spirit and scope of the appended claims.

DESCRIPTION OF A PREFERRED EMBODIMENT

Figure 1:
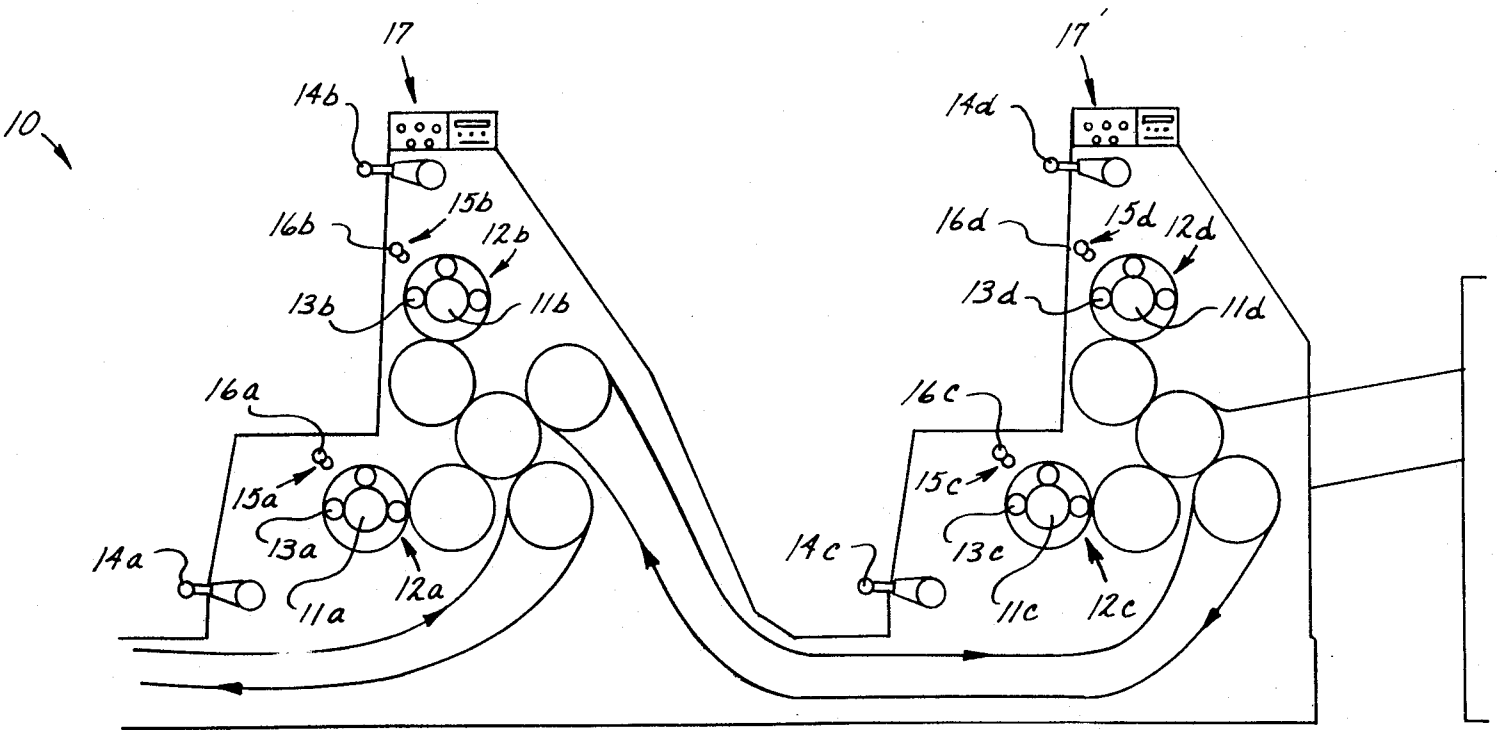
FIG. 1 is a side elevation of a multi-color printing machine including a compact adjustment system according to the invention inside the printing machine for register and color zone pre-setting.

Turning now to FIG. 1, there is shown a multi-color rotary printing machine generally designated 10 having four plate cylinders 11*a*, 11*b*, 11*c*, and 11*d* to which respective printing plates 12*a*–12*d* are mounted for individually printing four colors. So that the printings by the plate cylinders 11*a*–11*d* are precisely aligned, register adjusting devices 13*a*–13*d* are provided for each plate cylinder in order to adjust the axial and skew positions of the plate cylinders with respect to the frame of the printing machine 10 and to adjust the relative phases of the plate cylinders with respect to the rotary drive of the printing machine. The respective densities of the primary colors must also be regulated for proper color balance in the final print. For this purpose, zonal ink dosing devices 14*a*–14*d* are provided for regulating the amount of ink applied to axially-displaced inking zones on the printing plates 12*a*–12*d*.

In accordance with the invention, a traversing optical scanner 15*a*–15*d* is provided for each plate cylinder 11*a*–11*d*. Each optical scanner 15*a*–15*d* is mounted on a respective traversing mechanism 16*a*–16*d* mounted to the machine frame for axial scanning of the respective printing plate 12*a*–12*d* and including means for driving the respective optical scanner to a commanded axial position. At least one numerical computer 17, 17' preferably mounted on the frame of the printing machine 10 receives signals from the optical scanners 15*a*–15*d* and generates control signals for the traversing mechanisms 16*a*–16*b*, the register adjusting devices 13*a*–13*d* and the ink dosing devices 14*a*–14*d*. For the embodiment shown in FIG. 1 the numerical computer 17 receives optical scanners signals and generates control signals associated with the plate cylinders 11*a* and 11*b* while the second numerical computer 17' receives optical scanner signals and generates control signals associated with the plate cylinders 11*c* and 11*d*. The numerical computers 17, 17' are programmed to sense the axial and circumferential positions with respect to the machine frame and the machine drive, respectively, of register marks engraved on the printing plates 12*a*–12*d*, to align the axial and circumferential positions of the register marks with predetermined axial and circumferential positions, and to scan the printing areas on the printing plates to determine ink dosing control signals responsive to the ratio of printing to non-printing area in the respective inking zones on the printing plates. Thus, the optical scanners 15*a*–15*d* multi-functionally scan the printing plates 12*a*–12*d* to preset the register and zonal ink dosing within the printing machine 10 under control of the numerical computers 17, 17'.

If the positional deviation of any of the printing plates 12*a*–12*d* is excessive, the respective numerical computer 17, 17' signals the machine operator that the respective printing plate must be unclamped and readjusted.

The presetting system is arranged compactly in the printing machine 10 and is programmed for the specific properties and characteristics of the particular printing machine 10. The compact construction is easily fitted and the system is easily reprogrammed for printing machines of various types and sizes.

Figure 2:
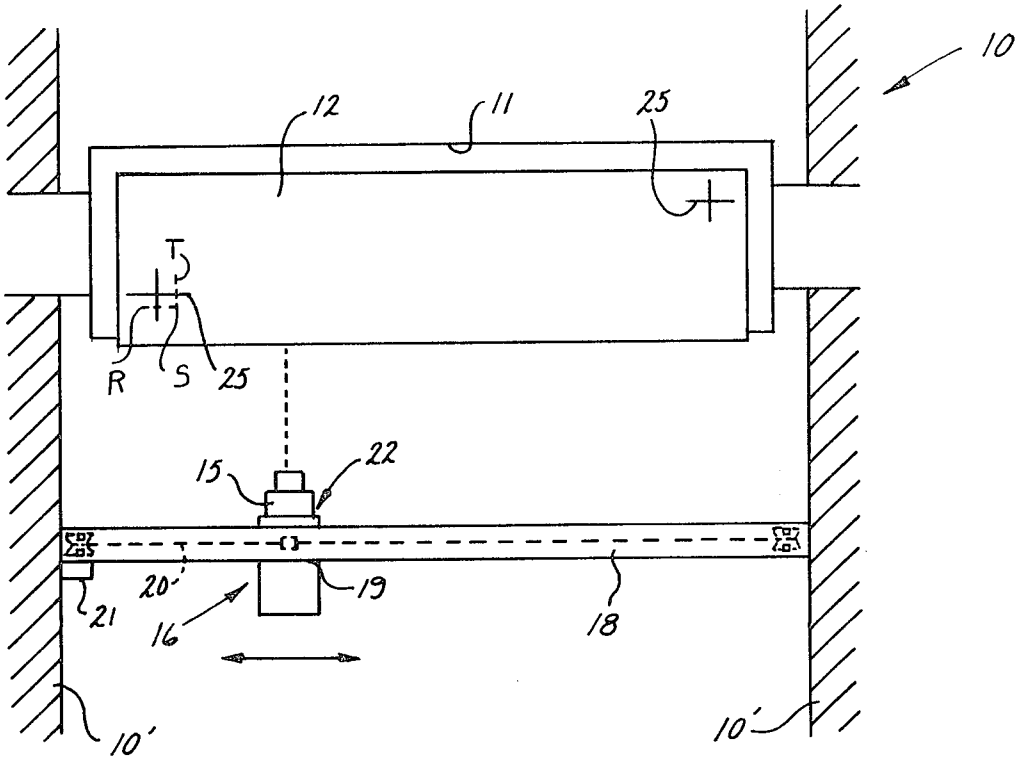
FIG. 2 is a schematic diagram showing the orientation of the optical scanner and traversing mechanism with respect to the plate cylinder and printing plate.

Turning now to FIG. 2 there is shown diagramatically the orientation of the optical scanner 15, the traversing mechanism 16, and the plate cylinder 11. The traversing mechanism 16 is of conventional construction similar to that used in plotting machines, and comprises an axial rail 18 parallel to the plate cylinder 11 engaged with a slide 19 linked by a cable 20 to a stepper motor 21. The rail 18 is easily cut to the required length and secured to the side frames 10' of the printing machine 10. The optical scanner 15 is interchangeably connected to the slide 19 of the traversing mechanism 16 through a bayonet mount 22. Preferably the bayonet mount 22 has an electrical interlock for inhibiting operation of the printing machine unless an optical sensor 15 is inserted in the bayonet mount, and the bayonet mount accepts a densitometer, interchangeable with the optical scanner, for sensing ink and dampening solution during continuous printing. To reduce measuring time during traversing, alternatively a number of axially-displaced optical scanners 15 may be mounted on the slide 19.

The optical scanner 15 senses register marks 25 engraved on the printing plate 12. The left mark 25 is scanned, for example, along segment RS to sense the axial position of the register mark and along segment ST to detect the circumferential position of the mark. The optical scanner 15 also scans the printing plate 12 to sense the ratio of the printing to non-printing area for the determination of the ink dosing pre-sets.

This multi-functional scanning allows the presetting to be greatly reduced because of the centralized and compact installation and because the adjustment and measuring operations for the plurality of scanning functions are combined into one operation for the particular printing machine.

If the printing plates are corrected or changed after the presetting operation, these corrections can be immediately taken into account by repeating the presetting operation without access to or use of remote control terminals or data processing units external to the printing machine.

Figure 3:
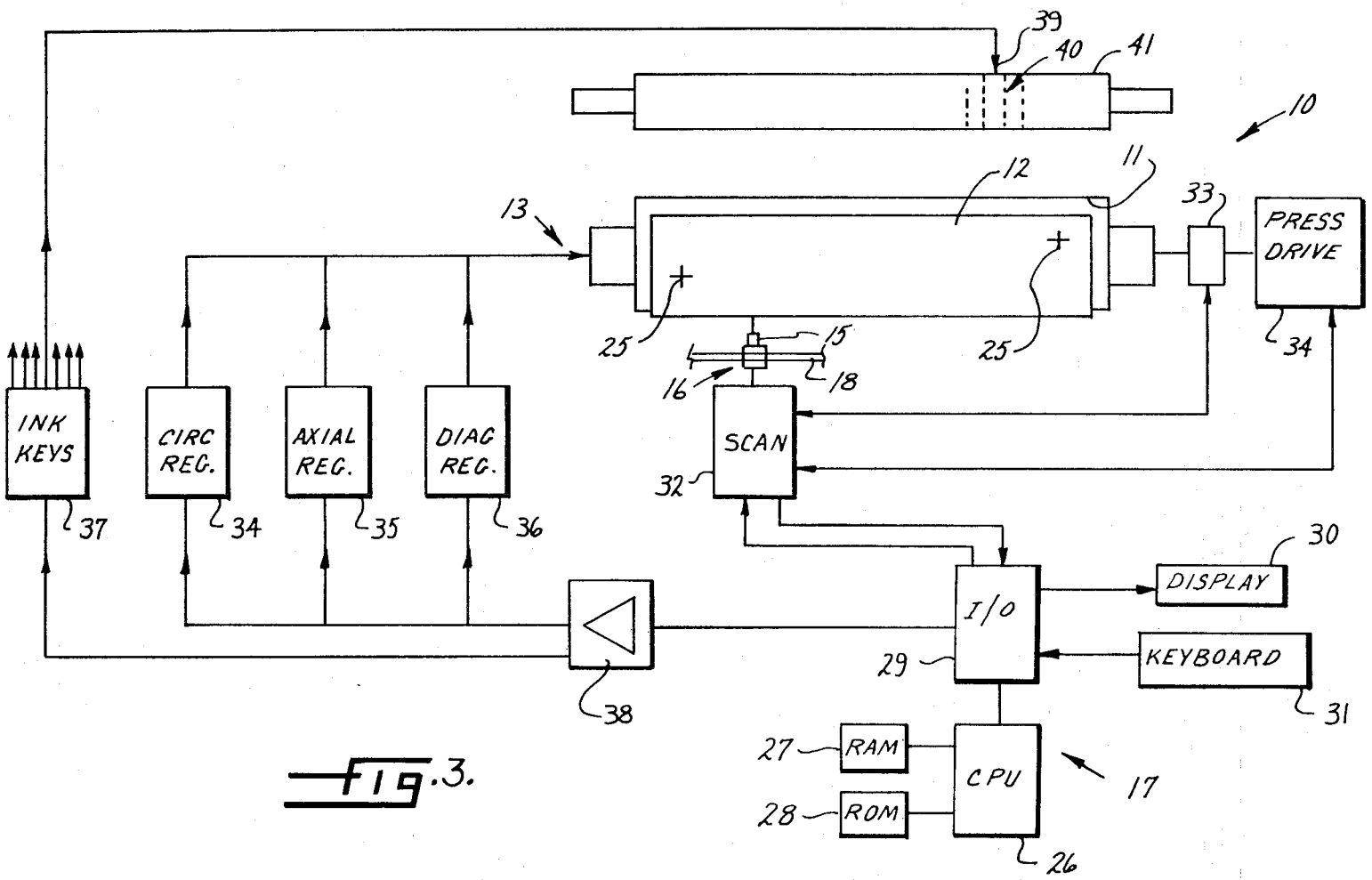
FIG. 3 is a schematic block diagram of the pre-setting control system according to the invention.

Shown in FIG. 3 is a schematic block diagram of the presetting system including the major components of the numerical computer 17 and the interface components between the numerical computer and the printing machine 10, optical scanner 15, and press operator. The numerical computer 17 comprises a central processing unit 26, random access or volatile memory 27, read-only or non-volatile memory 28, and input/output circuits 29. The non-volatile memory 28 includes the program executed by the central processing unit 26 as well as certain predetermined reference values programmed for the particular printing machine 10. Preferably the portion of the non-volatile memory storing the reference values is eraseable or electrically alterable for the "calibration" of a particular printing machine. Thus, what would ordinarily be a mechanical calibration adjustment is performed by altering corresponding reference values stored in the non-volatile memory 28. The volatile memory 27, on the other hand, stores the data obtained by scanning the printing plate, intermediate results, or set-up data entered by the machine operator for a particular job. The volatile memory 27, in other words, is adapted to be erased after a presetting operation.

The numerical control computer 17 communicates with the printing machine operator via a display 30 and a keyboard 31. Scanning commands and data pass through intermediate scanning circuits 32 including an analog-to-digital converter generating numeric samples of the scanner signal and drive circuits for the stepper motor 21 in the traversing mechanism 16. The scanning circuits 32 also receive the output of an angle resolver 33 coupled to the press drive 34 and the plate cylinder 11. The angle resolver 33 is preferrably a high precision dgital resolver of the kind used in the machine control industry. A representative resolver is known as an Inductosyn precision rotary position transducer manufactured by Farrand Controls, Division of Farrand Industries, Inc. 99 Wall Street, Valhalla, N.Y., 10959. Thus, the numerical control unit 17 obtains through the scanning circuits 32 the axial coordinate of the scanner 15 from the traversing mechanism 16 and the angular coordinate of the printing plate 12 from the resolver 33.

The numerical computer 17 senses the positions of the register marks 25 and by comparing the measured positions to predetermined reference values calculates register errors. To reduce the register errors to approximately zero, the numerical computer 17 is interfaced through a suitable drive or power amplifier 38 to circumferential register 34, axial register 35 and diagonal register 36 servos of the register adjusting device 13. Similarly, the power amplifier 38 drives servos 37 for the ink keys 39. The adjusting devices for the ink keys and register as well as the drive or power amplifier 38 are known components of remote controls for printing machines.

Once plate register has been adjusted, the numerical computer 17 drives the optical scanner 15 to determine the ratio of printing to non-printing area on the printing plate 12. The scanning may occur in a circumferential fashion, in which the press drive 34 operates continuously and the traversing mechanism 16 operates intermittently, or alternatively in an axial fashion wherein the traversing mechanism operates continuously while the press drive operates slowly or intermittently. For circumferential scanning, the measuring travel of the optical scanner 15 is preferably somewhat larger than the width of the inking zones 40 in order that the edge zones can be satisfactorily associated with one another in the regions of the zone transitions. In both the axial and circumferential scanning modes, the measured contrasts on the printing plate 12 are evaluated in the same fashion. The optical measurements are integrated in the circumferential direction with respect to the corresponding positions of the widths of the inking zones 40. The numerical computer 17 obtains the positions of the widths of the inking zones from the portion of the read-only memory 28 storing predetermined reference values for the particular printing machine 10. Based on the integrated values for the respective inking zones 40, the numerical computer 17 generates color zone preset signals sent through the power amplifier 38 to the ink key adjusting devices 37. The ink keys 39 zonally apply ink to a ductor roller 41 from which ink is transferred to the printing plate 12.

Figure 4:
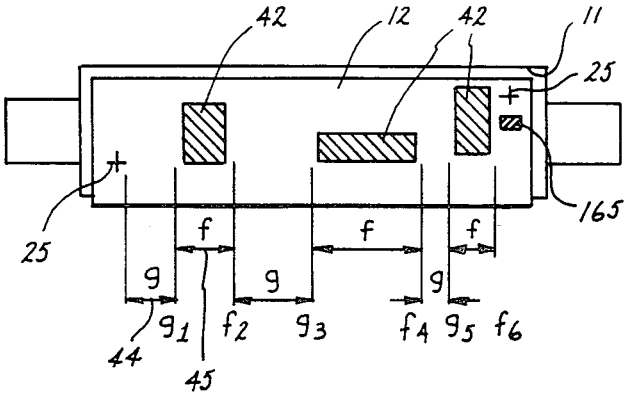
FIG. 4 is a schematic diagram of the plate cylinder and printing plate showing printing and non-printing areas, and the fine and coarse scanning zones defined by the printing areas.

Turning now to FIG. 4 there is shown a schematic diagram of a particular printing plate 12 including printing regions 42 engraved on the printing plate. Also shown are the circumferential coarse (g) and fine (f) zones for circumferential scanning of the printing plate 12. Preferably, in the circumferential scanning mode the scanner 15 traverses axially at high speed in the coarse zones (g) since it is already known that the ratio of printing to non-printing area in the coarse zones is zero. In the fine zones (f), however, the scanner 15 must be driven more slowly to accurately determine the ratio of printing to non-printing area since the fine zones (f) include printing regions 42. Similarily, in the case of axial scanning, considerable scanning time may be saved if the press drive 34 is rapidly driven so that the scanner 15 skips over axial coarse zones.

Figure 5:
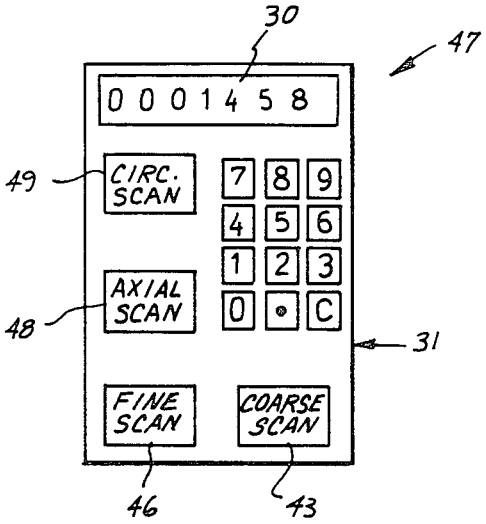
FIG. 5 is a pictorial view of a keyboard for inputting the coarse and fine scanning coordinates and for selecting either circumferential or axial scanning.

Shown in FIG. 5 is a pictorial diagram of the keyboard 31 and the display 30 for permitting the operator to enter the coordinates of the coarse and fine scanning zones and to select either circumferential or axial scanning. For the case of circumferential scan with the plate 12 in FIG. 4, the operator punches the numeric keys or the clear key (C) to enter on the display 30 the coarse coordinate g1 and, once the proper coordinate is entered, the operator depresses the coarse scan key 43 so that the numerical computer 17 accepts the number on the display 30 as indicating the end of the first course zone 44. Next, the operator enters the axial coordinate $f_2$ of the end of the first fine scan zone 45, and once the proper number is on the display 30, the operator depresses the fine scan key 46. Following this procedure, the operator successively enters the axial coordinates $g_3$, $f_4$, $g_5$, $f_6$ and depresses the respective coarse or fine scan keys 43, 46 to enter into the numerical computer 17 the axial positions of the printing regions 42. In the exemplary embodiment of the invention the keyboard 31 and display 30 comprise a compact control unit 47 mounted on the outside of the printing machine 10.

Figure 6:
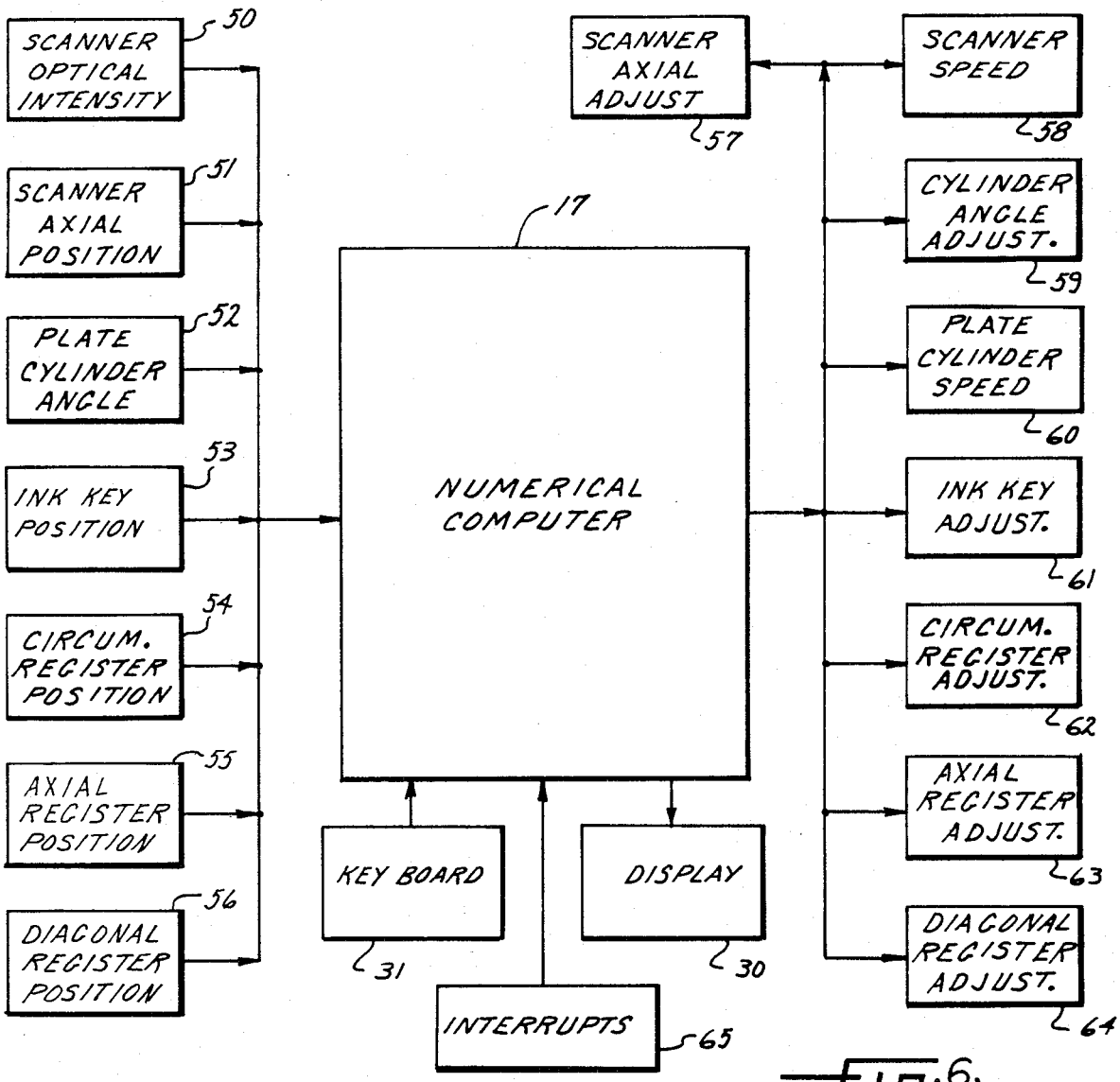
FIG. 6 is a block diagram of the inputs and outputs with respect to the numerical computer.

Turning now to FIG. 6 the individual inputs and outputs for the numerical computer 17 are shown diagramatically. The inputs comprise the scanner optical intensity 50 obtained from an analog-to-digital converter in the scan circuits 32 of FIG. 3, the scanner axial position 51 obtained from the traversing mechanism 17, the plate cylinder angle 52 obtained from the resolver 33, the ink key position 53 obtained from the ink keys 38, the circumferential register position 54 obtained from the circumferential register adjusting device 34, the axial register position 55 obtained from the axial register adjusting device 35, and the diagonal register position 56 obtained from the diagonal register adjusting device 36. The outputs of the numerical computer 17 comprise the scanner axial adjustment 57 commanding the position of the traversing mechanism 16, the scanner speed 58, the commanded cylinder angle adjustment 59, the commanded plate cylinder speed transmitted to the press drive 34, the ink key adjustments 61 fed to the ink key adjusting devices 37, the circumferential register adjustment 62 sent to the circumferential registering adjusting device 34, the axial register adjustment 63 transmitted to the axial register device 35, and the diagonal register adjustment 64 sent to the diagonal register device 36. It should be noted that the numerical computer 17 is given access to the actual positions of the adjusting devices. Thus, it can check whether the commands have been executed by the adjusting devices. Alternatively, the task of determining whether the commands have been executed may be delegated to the adjusting devices. In this case, the adjusting devices transmit interrupts 65 to the numerical computer 17 to signal error conditions.

Figure 7:
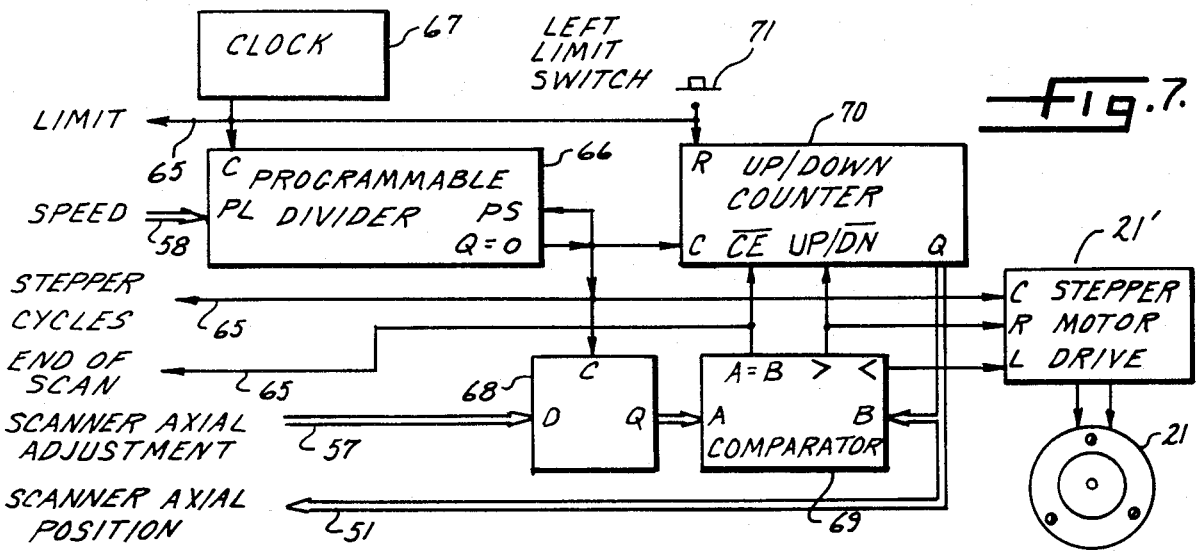
FIG. 7 is a block diagram of an interface for the stepper motor of the traversing mechanism and is representative of the interfaces for the other remote control adjusting devices.

An adjusting device for the stepper motor 21 of the traversing mechanism 16 is shown in FIG. 7. The speed of the stepper motor 21 is determined by a programmable divider 66 clocked at a constant rate by a clock generator 67 and periodically loaded with the commanded scanner speed 58. The Q=0 output of the programmable divider 66 is used as a preset signal thereby resulting in a programmable frequency defining stepper motors cycles. This programmable frequency is fed to the stepper motor drive circuits 21' and is also used as an optional interrupt 65 to the numerical computer 17. On each stepper motor cycle, the scanner axial adjustment 57 is sampled by a register 68 and fed to a numerical comparator 69 also receiving the presumed position of the traversing mechanism 17 provided by an up/-down counter 70 clocked by the stepper cycles and enabled for up or down counting depending on the output of the comparator 69. The outputs of the comparator 69 are also fed to the stepper motor drive 21' for left or right steps of the traversing mechanism 16 in order that the up/down counter is incremented up or down in accordance with the right or left steps of the stepper motor 21. The up/down counter 70 is set to zero by a limit signal from a left limit switch 71 which closes at a predefined zero position of the traversing mechanism 16. Thus, once the counter 70 is properly zeroed, the stepper motor 21 drives the scanner 15 to the scanner axial adjustment 57 since the counter and stepper motor are simultaneously cycled up or down until the scanner axial position 51 is equal to the scanner axial adjustment 57. The end of scan condition is optionally used as an interrput 65 and is obtained from the A=B output of the comparator 69. The comparator 69 accepts a wider range of numerical values on its A input receiving the scanner axial adjustment 57 than it does on its B input receiving the scanner axial position 51 so that regardless of the initial state of the counter 70, the maximum scanner axial adjustment and the minimum scanner axial adjustment will drive the stepper motor 21 right and left, respectively.

The device for adjusting the angular position of the press drive 34 could use a press drive stepper motor and a circuit similar to that shown in FIG. 7. It is preferable, however, to use a servo control loop exciting the press drive motor with an error signal obtained by comparing the output of the resolver 33 to the desired cylinder angle adjustment 59.

Figure 10:
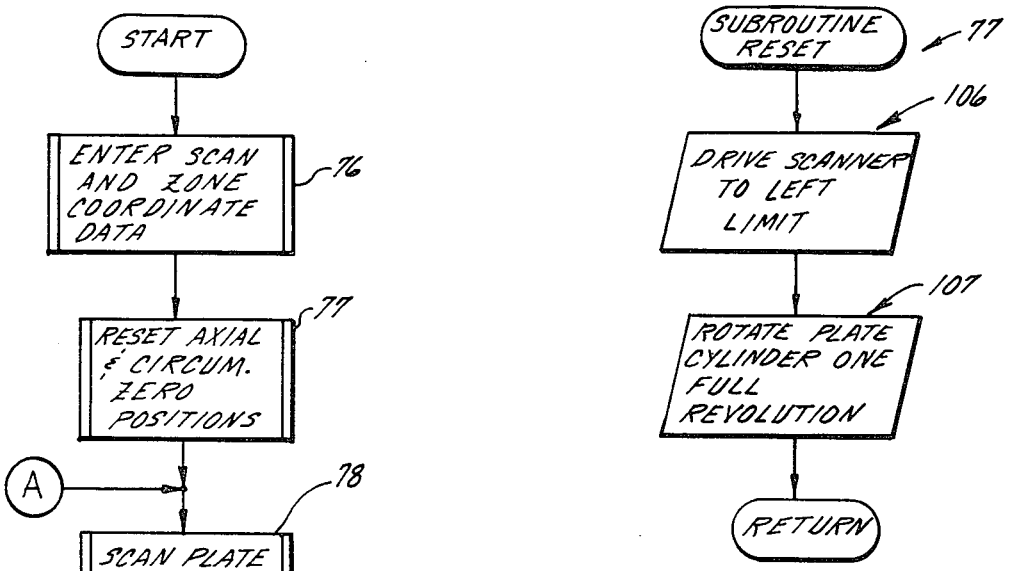
FIG. 10 is a flowchart of a subroutine for resetting the axial and circumferential zero positions.

Turning now to FIG. 10, there is shown a flowchart of an executive program for the numerical computer 17. In the first step 76 the computer receives scan and zone coordinate data from the printing machine operator through the control unit 47 (FIG. 5). Then in step 77 the axial and circumferential zero positions of the traversing mechanism 16 and the resolver 33, respectively, are reset. Now that the computer knows the precise location of the printing plate 12 scanned by the optical scanner 15, the register control sequence starts with step 78 by scanning the register marks 25 and determining their relative positions. In step 79, the register errors are calculated from the deviations of the positions of the register marks from their desired positions. In step 80, the register errors are tested to determine whether they are sufficiently small. If not, the register adjustment devices are commanded to reduce the register error. The register adjusting procedure, in other words, is repeated until the register error is sufficiently small, within the precision of the measurement and adjustment of register mark position. In step 81, the number of iterations performed is compared to a maximum limit value. If the limit value is exceeded, the number of iterations is excessive, and in step 82 the operator is told that an error has occured and the printing plate 12 should be unclamped and repositioned. The computer 17 waits in step 83 for the operator to signal that the plate has been repositioned. If, however, in step 81 the number of iterations was not excessive, then in step 84 register is adjusted by commanding the register adjustment devices 13 to eliminate the register errors. After register is adjusted in step 84, the plate register marks 25 are again scanned in step 78 and the register error is recalculated in step 79 until the register error is found in step 80 to be within acceptable limits.

Once the register error is sufficiently small, the ink zone presets are determined. Starting with step 85 the optical scanner 15 is calibrated by driving the scanner to predetermined positions on the printing plate 12 having no printing and maximum printing density to obtain maximum and minimum optical intensity values, respectively. Using the maximum and minimum optical intensities, the signal from the optical scanner 15 is numerically normalized so as to be unresponsive to the ambient level of illumination and the gain of the response of the optical scanner. In step 86 the printing plate 12 is scanned to obtain the ratio of printing to non-printing area for each inking zone. Using these ratios for the inking zones, the ink zone presets are calculated in step 87 and the ink keys are adjusted accordingly in step 88.

At the end of step 86, the register and ink key presets have been completed.

Figure 8:
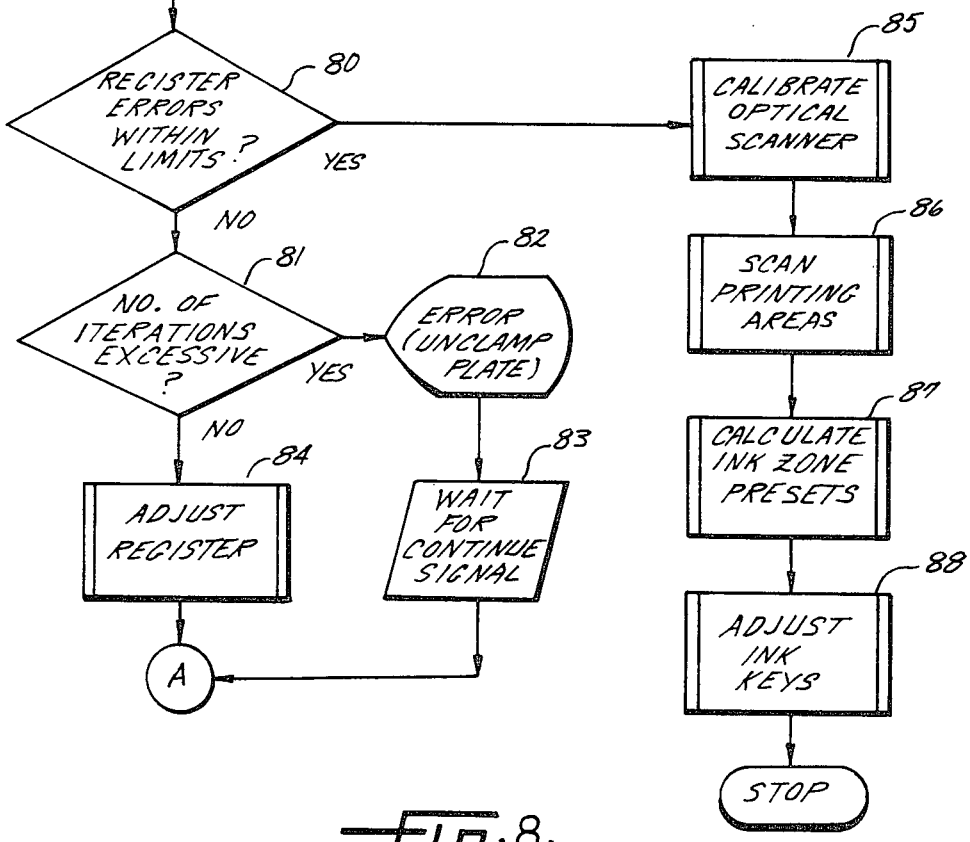
FIG. 8 is a flowchart of the executive program executed by the numerical computer to perform the presetting operations.
Figure 9:
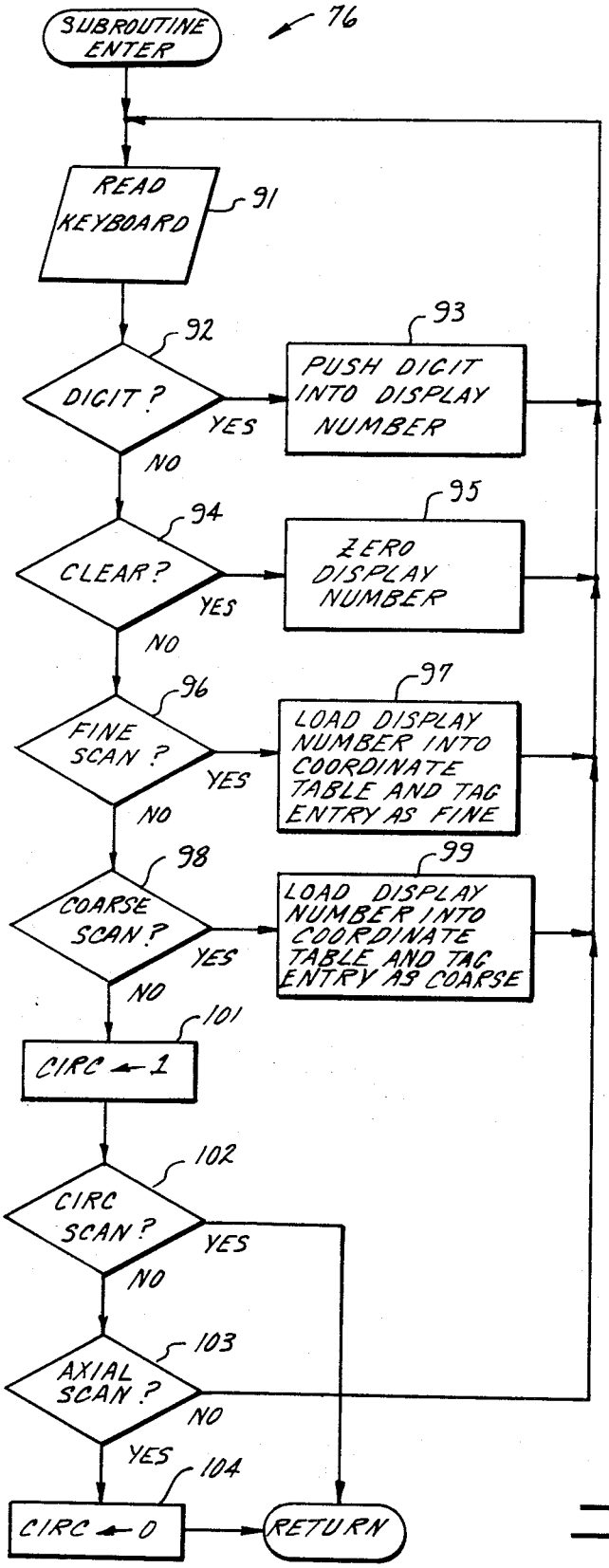
FIG. 9 is a flowchart of a subroutine for entering data through the keyboard of FIG. 5.

Turning now to FIG. 9, there is shown a flowchart for a subroutine to perform the data entry step 76 in FIG. 8. In the first step 91, the keyboard 31 is scanned for any key closures. If a digit key is closed as tested in step 92, then in step 93 the digit is pushed into the right-most position of the number in the display 23. If the clear key (C) is closed as tested in step 94, the number in the display 23 is set to zero in step 95. If the fine scan key 46 is closed as tested in step 96, then in step 97 the number in the display 23 is loaded into a coordinate table and is tagged as fine. The number in the display is also cleared to inform the operator that the number was loaded into the coordinate table. If the coarse scan key 43 is closed, then in step 99 the number in the display 23 is loaded into the coordinate table and tagged as coarse. The number in the display is also cleared to indicate acceptance of the number. Thus, the operator can successively enter numbers, clear the display, and instruct the computer to accept the numbers as coarse or fine coordinates. Once all of the coordinates have been entered, the operator depresses either the axial scanning key 48 or the circumferential scanning key 49 to terminate the data entry sequence. A flag CIRC is used to indicate whether circumferential or axial scanning is selected by the operator. In step 101, the flag CIRC is set to 1 and if the circumferential scan key 49 is closed as tested in step 102, the data entry subroutine 76 is finished. Otherwise, if the axial scan key 48 is closed as detected in step 103, the flag CIRC is cleared in step 104 and the data entry subroutine 76 is finished.

Turning to FIG. 10 there is shown a subroutine 77 for resetting the axial and circumferential zero positions. The axial zero position is reset in step 106 by driving the scanner 15 to the left limit switch (71 in FIG. 7). The numerical computer 17, in other words, transmits a minimum value of scanner axial adjustment 57 to the scanner circuits in FIG. 7, and upon closure of the limit switch the computer transmits a scanner axial adjustment of zero. Hence, at the end of step 106, the scanner 15 is at the left limit position defining the axial coordinate of zero. In step 107, the plate cylinder is rotated one full revolution in order that the scanning circuits 32 working in conjunction with the resolver 33 are similarly reset to zero.

Figure 11:
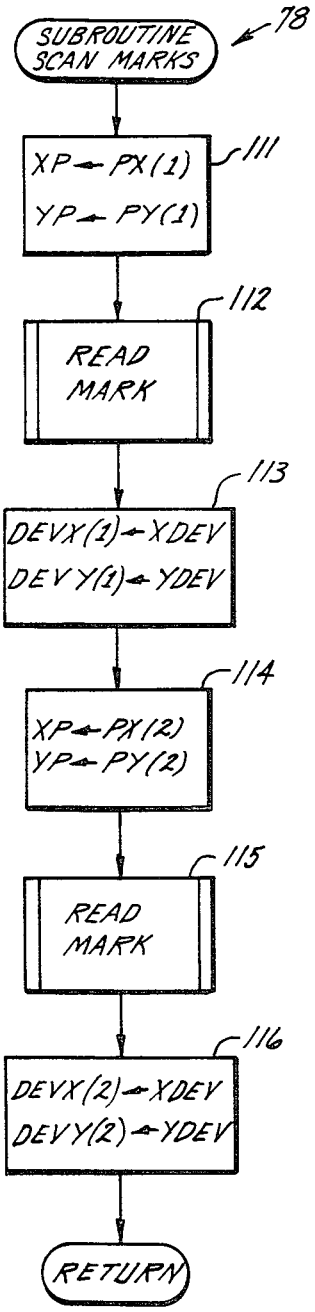
FIG. 11 is a flowchart of a subroutine which scans right and left register marks on the printing plate.

Turning now to FIG. 11, there is shown a subroutine 78 for scanning the register marks 25. In step 111 variables XP and YP are set equal to the desired coordinates of the left register mark. Then in step 112 the deviations of the left register mark from the desired coordinates are determined by calling a READ MARK subroutine. In step 113, these deviations are temporarily stored. Similarly, in step 114 the variables XP and YP are set equal to the desired coordinates of the right register mark. The READ MARK subroutine is called in step 115 and the deviations of the right register mark from the desired coordinates are temporarily stored in step 116.

Figure 12:
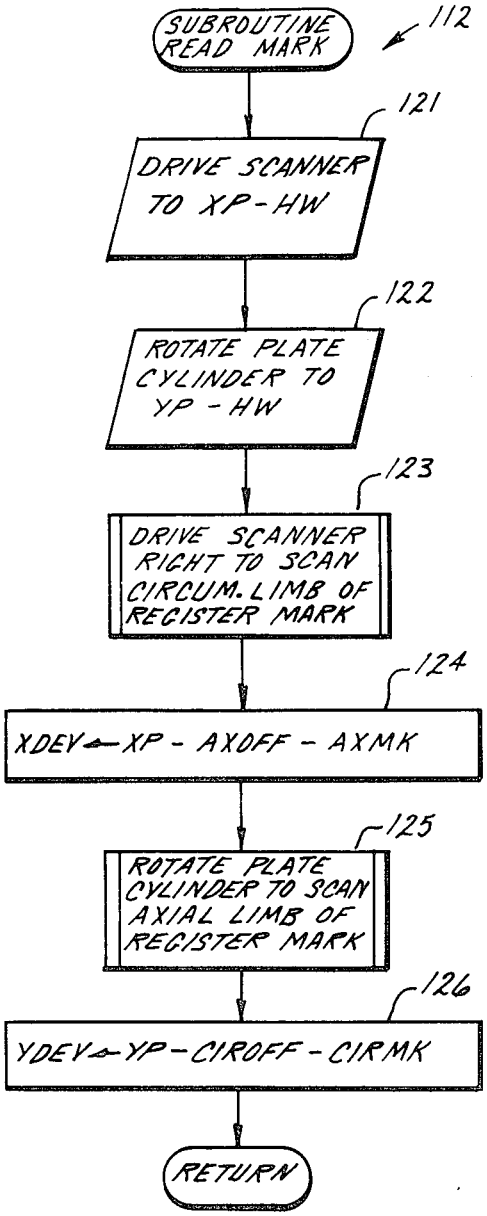
FIG. 12 is a flowchart of a subroutine for reading individual register marks in the form of crosses.

A flowchart for the READ MARK subroutine 112 is shown in FIG. 12. In the first step 121, the scanner 15 is driven to the desired axial coordinate XP less a predetermined value HW representing one quarter of the width of the register mark 25. In step 122 the plate cylinder 11 is rotated to the desired circumferential coordinate YP less the predetermined value HW. Thus, the scanner is focused, for example, on the point R in FIG. 2. In step 123, a subroutine is called to drive the scanner to point S to scan the circumferential limb of the register mark 25. The result of the subroutine in step 123 is the axial position of the mark AXMK which is subtracted in step 124 from the desired position XP to obtain the axial deviation of the register mark from its desired position. The computation in step 124 also includes the subtraction of an axial offset AXOFF which is a predetermined reference value used to compensate for any axial alignment errors in the register measuring system. The value for the axial offset AXOFF is determined by the usual procedure of printing a test sheet and determining the alignment errors of superimposed register marks on the printed sheet. But instead of performing a mechanical adjustment to the mounting of the densitometer 15, an equivalent adjustment is made by changing the value of the axial offset AXOFF. In step 125 a subroutine is called to scan the axial limb of the register mark by rotating the cylinder 18 so that the scanner 15 scans the segment ST (FIG. 2). The subroutine in step 125 is virtually identical to the subroutine in step 123 except that the numerical computer 17 rotates the cylinder 11 instead of driving the scanner 15 in the axial direction. The subroutine in step 125 returns the circumferential position of the mark CIRMK which is used in step 126 to calculate the circumferential deviation of the register mark 25 from its desired position. Step 126 also provides for a circumferential offset CIROFF.

Figure 13:
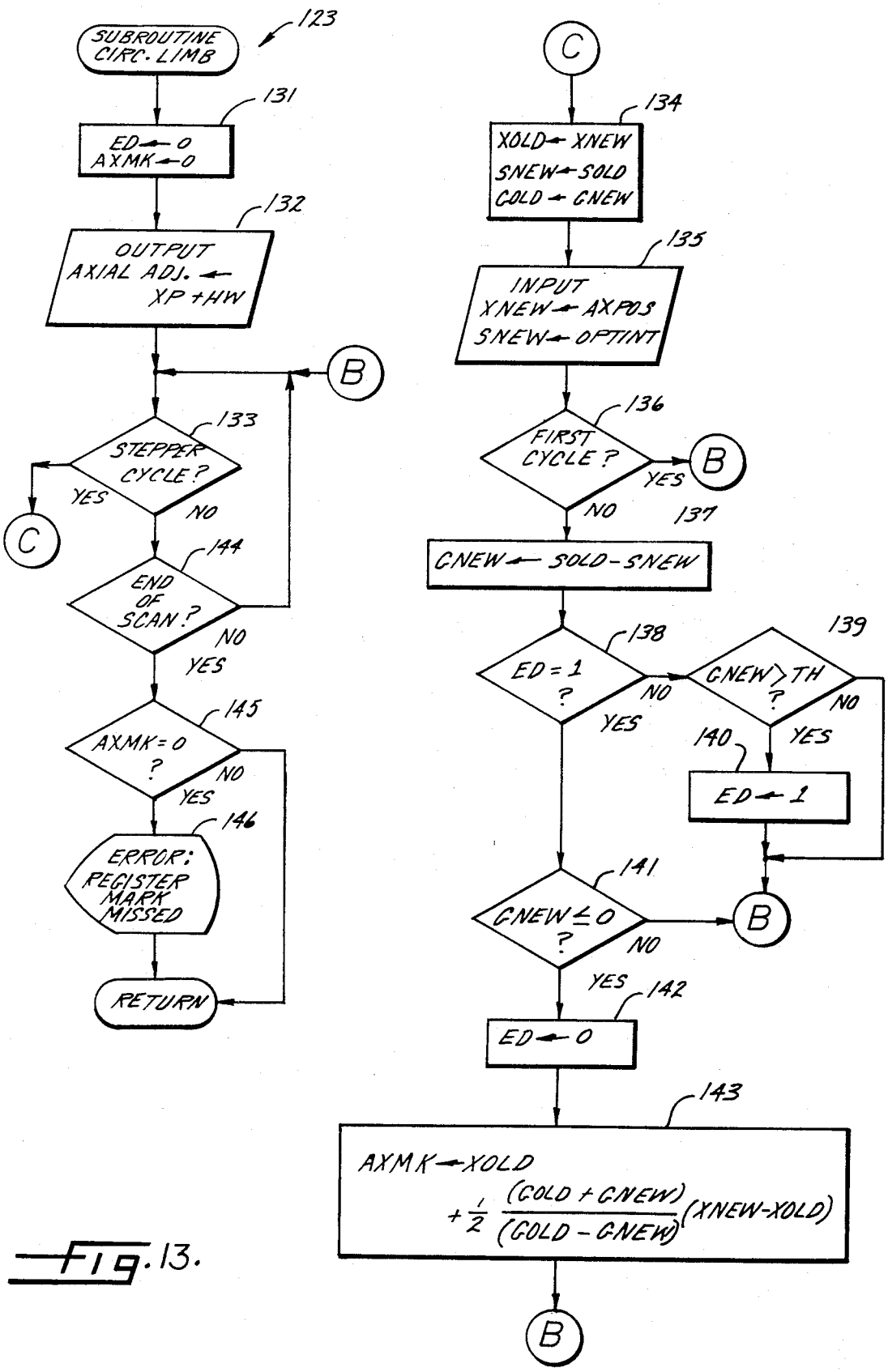
FIG. 13 is a flowchart of a subroutine which scans the circumferential limb of a register cross.

Shown in FIG. 13 is a flowchart of the subroutine 123 for scanning the circumferential limb of the register mark 25. In general terms, the subroutine 123 steps the scanner 15 across the circumferential limb of the mark 25 and for each step obtains a numerical value of the optical intensity received by the scanner. The gradient or change in light intensity as a function of position is calculated as the difference between the successive numerical values of light intensity. To detect the presence of the circumferential limb of the register mark, the gradient is compared to a predetermined threshold and if the predetermined threshold is exceeded then the register mark is detected. The position of the register mark is sensed as the step or position for which the gradient in the light intensity drops to zero immediately after the detection of the register mark. In other words, the register mark is detected when the optical scanner is focused on the light-to-dark edge of the register mark. The position of the register mark, however, is detected when the optical scanner is positioned directly on the dark limb of the register mark.

In the first step 131 of the subroutine 123 an edge detect flag ED is set to zero and the returned position value AXMK is also set to zero. The subroutine 123 uses the edge detect flag ED to indicate whether the circumferential limb has been detected. In step 132, the scanner axial adjustment is set to a value of XP plus HW in order to drive the scanner from point R to point S (FIG. 2). The scanning then proceeds on an iterative basis, a number of computer program steps being repeated for each increment along the segment RS.

In step 133, the iterative process is initiated for each stepper cycle. In step 134, the axial position, the optical intensity sample, and the gradient for the previous cycle is temporarily stored. In step 135 the current values of the axial position and optical intensity are sampled and temporarily stored. In step 136, processing for the first iteration is terminated since two samples of the optical intensity are required to calculate the gradient. In step 137, a negative gradient GNEW is calculated as the difference between the old and new optical intensity samples. A negative rather than a positive gradient is calculated since the register mark 25 is presumed to be a dark-on-light mark. In step 138 the edge detect flag ED is compared to one and, if it is not equal to one, the negative gradient is compared in step 139 to a predetermined threshold TH to determine whether the optical scanner is focused on a register mark 25. If the threshold is exceeded, then in step 140 the edge detect flag ED is set to one.

Once the register mark 25 is detected, then after step 138 the gradient is compared to zero in step 141 to determine if the optical scanner 15 has just passed the center of the circumferential limb of the register mark 25. If the gradient is less than or equal to zero, then in step 142 the edge detect flag is set to zero to terminate the search for the center position of the circumferential limb of the register mark. Due to the fact that the gradient is being tested in step 141 and the gradient is the difference between the optical intensity at the current and previous axial positions, the axial position of the register mark AXMK is approximately equal to the previous axial position XOLD. Moreover, an even more precise estimate of the axial position of the register mark is obtained by proportionally considering the current and previous gradients using the calculations in step 143.

The iterative process terminates as a result of an end of scan interrupt or signal sensed in step 144. Before returning from the subroutine 123, however, the axial position of the mark AXMK is compared in step 145 to zero to determine whether a register mark has in fact been detected. If the axial position AXMK is equal to zero, then a register mark has not been detected and in step 146 an error message is displayed to the operator.

Figure 14:
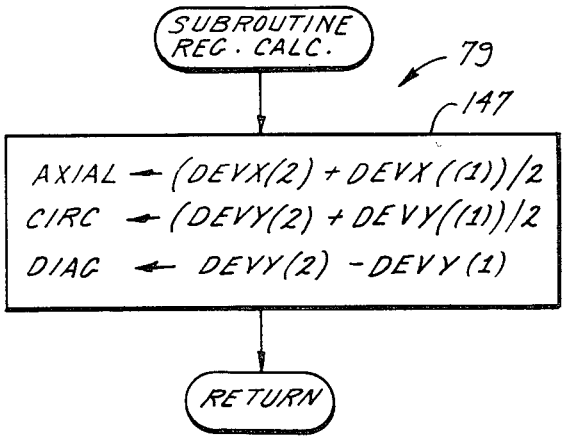
FIG. 14 is a flowchart of a subroutine which calculates the axial, circumferential and diagonal register errors.

Turning now to FIG. 14 there is shown a flowchart of the subroutine 79 for calculating the register errors. The subroutine 79 comprises calculations 147 for the axial, circumferential, and diagonal or skew deviations in terms of the axial and circumferential deviations of the left and right register marks 25 determined by the register mark scan subroutine 78 in FIG. 11.

Figure 15:
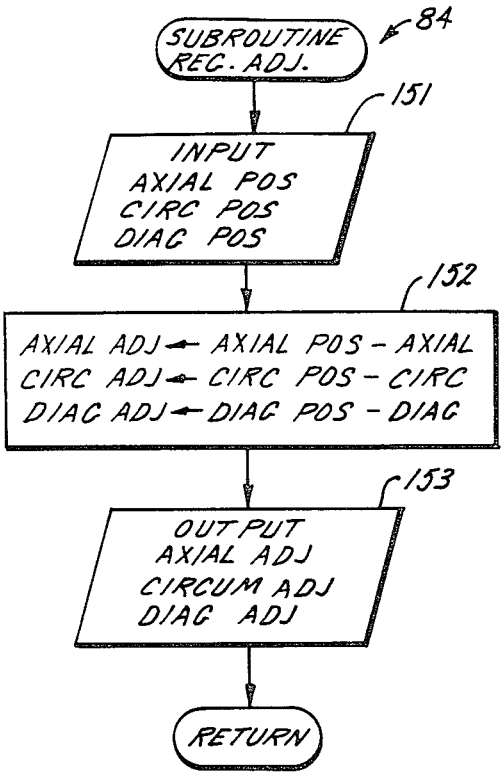
FIG. 15 is a flowchart of a subroutine for determining the axial, circumferential and diagonal adjustments.

The register adjustments are performed by the subroutine 84 shown in FIG. 15. In the first step 151 the axial register position, circumferential register position, and diagonal register position are received by the numerical computer 17. In step 152 the respective register adjustments are calculated as the differences between the respective register positions and the register errors. In step 153 the register adjustments are tramsmitted to the register adjusting devices 13.

Figure 16:
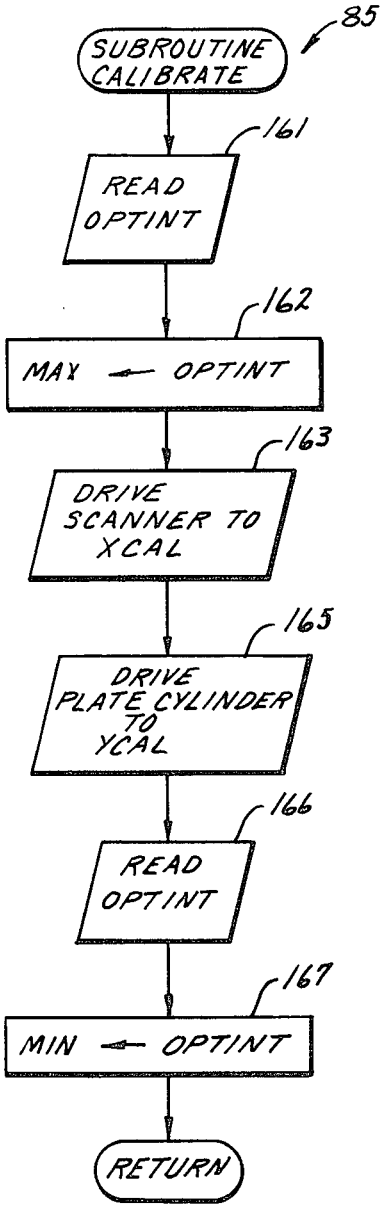
FIG. 16 is a flowchart of a subroutine for calibrating the optical scanner.

Turning now to FIG. 16 there is shown a flowchart of the subroutine 85 for calibrating the scanner 15. In the first step 161, the numerical computer 17 reads the optical intensity from the optical scanner 15. At this time the optical scanner is focused on a non-printing area of the plate 12. Thus, in step 162 the optical intensity is stored as a maximum value of optical intensity. In steps 163 and 164, the scanner and plate cylinder are driven so that the scanner 15 is focused on a region 165 of maximum printing area on the printing plate 12 (FIG. 4). In step 166 the optical intensity is read and in step 167 the optical intensity is stored as a minimum value of optical intensity. Thus, values of optical intensity within the maximum and minimum values of optical intensity represent a ratio of printing to non-printing area ranging from one to zero.

Figure 17:
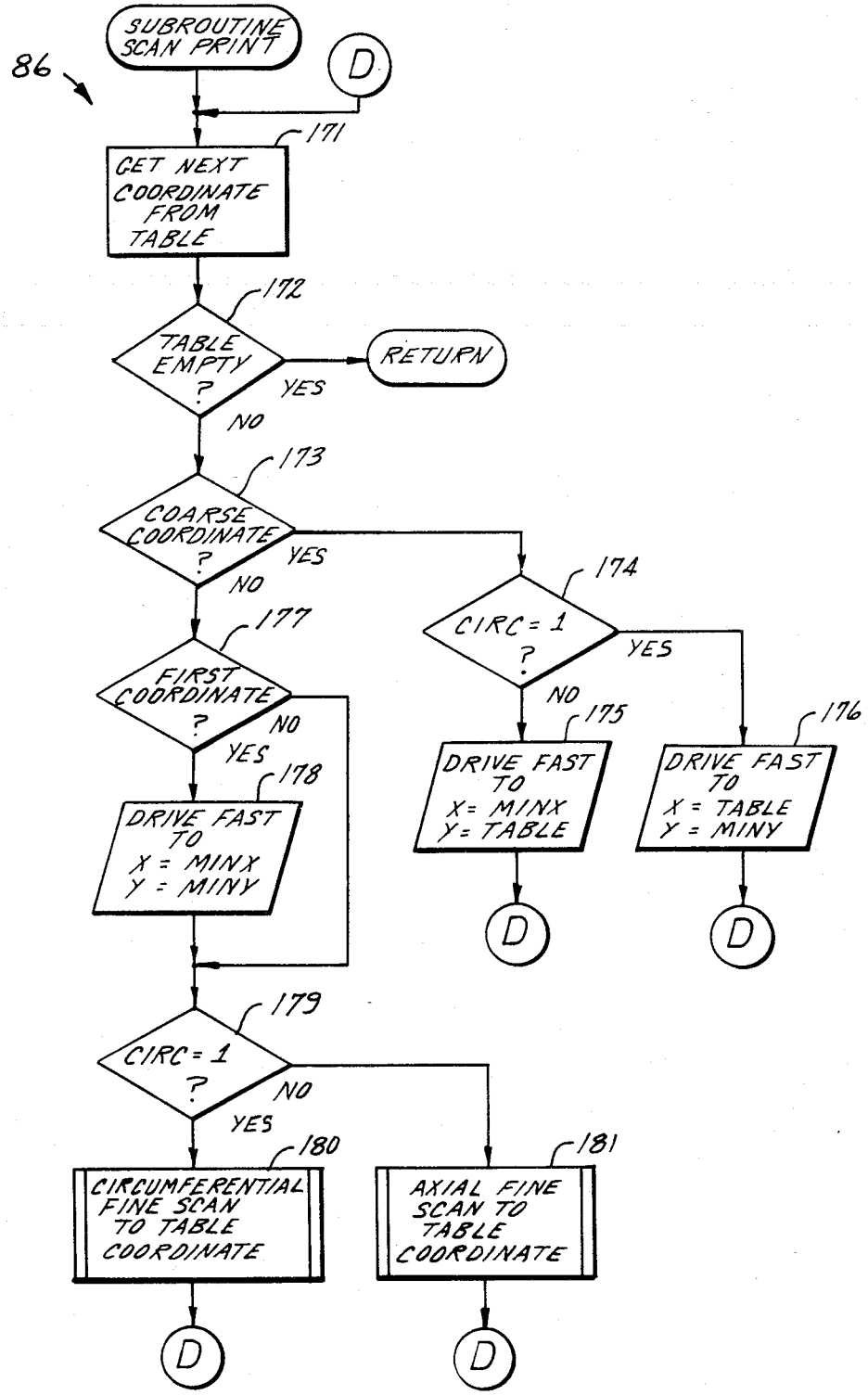
FIG. 17 is a flowchart of a subroutine which scans the printing and non-printing areas on the printing plate to determine color zone presets.

Turning now to FIG. 17, there is shown a flowchart of the subroutine 86 for scanning the printing plate 12 to determine the overall ratio of printing to non-printing area for each of the inking zones 40. In the first step 171, the next coordinate is obtained from the coordinate table that was loaded by the data entry subroutine 76 of FIG. 9. If, however, the table is empty as tested in step 172, the scanning subroutine 86 is finished. Otherwise, in step 173, the numerical computer 17 senses whether the coordinate is coarse or fine by reading the tag or corresponding flag in the coordinate table. If the coordinate is coarse, then depending on whether circumferential or axial scanning was selected as tested in step 174, the coarse coordinate is interpreted as either a circumferential or axial coordinate. In the case of axial scanning, in step 175 the numerical computer 17 drives the scanner 15 at high speed to a minimum axial coordinate and rotates the plate cylinder 11 to a circumferential angle specified by the table coordinate. If circumferential scanning was selected, however, in step 176 the numerical computer 17 drives the scanner 15 at high speed to an axial coordinate specified by the table coordinate, and rotates the plate cylinder to a minimum circumferential coordinate.

If the table coordinate was a fine coordinate as tested in step 173, then scanning proceeds from the current to the fine coordinate unless the fine coordinate is the first coordinate in the table. If the fine coordinate is the first coordinate in the table, as sensed in step 177, then the scanner and plate cylinder are first driven in step 178 to the minimum axial and circumferential coordinates. Then, depending on whether axial or circumferential scanning was selected as tested in step 179, fine scanning proceeds in a circumferential fashion in step 180 or in an axial fashion as performed in step 181.

Figure 18:
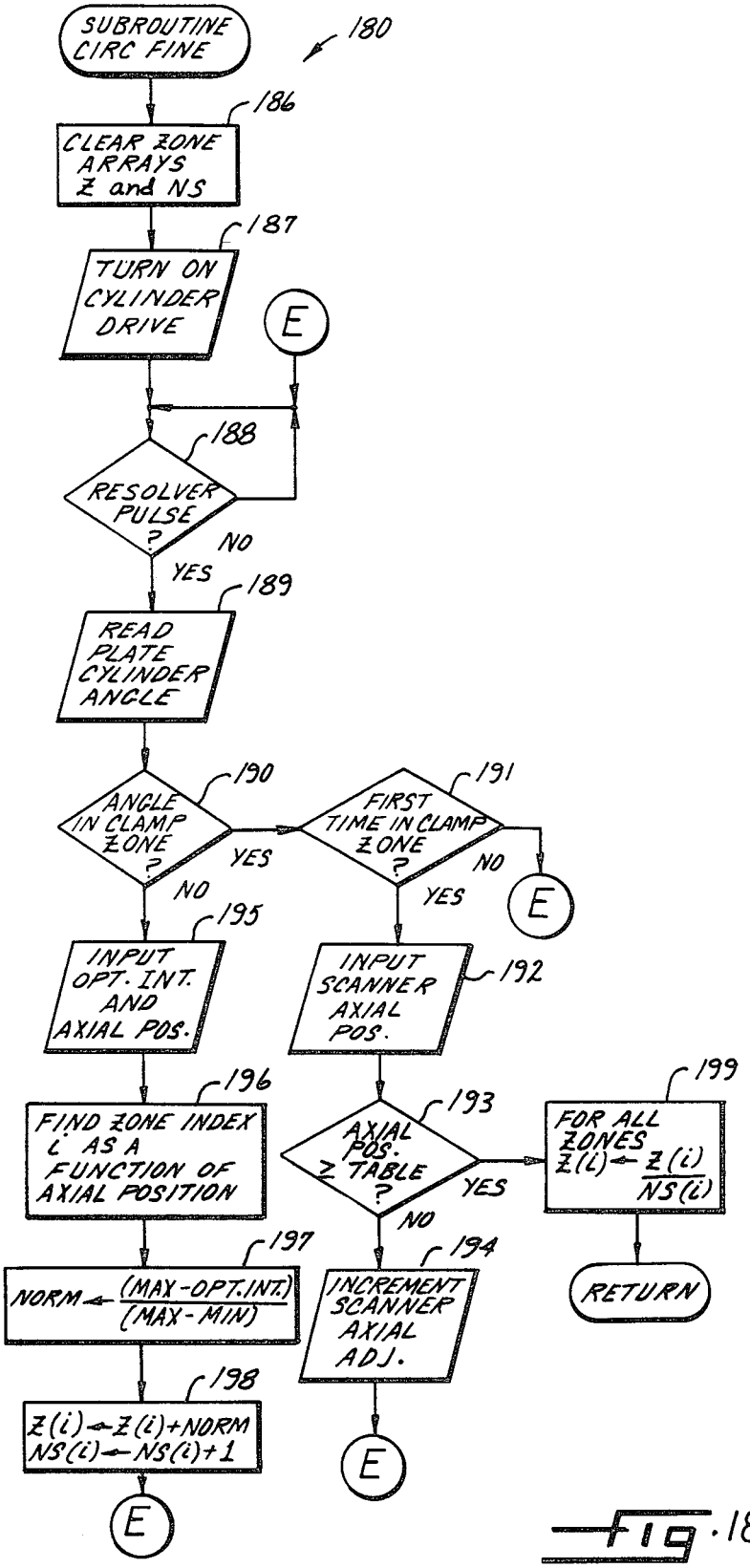
FIG. 18 is a flowchart of a subroutine which performs circumferential fine scanning.

Turning now to FIG. 18, there is shown a flowchart of the subroutine 180 for circumferential fine scanning. The result of fine scanning in either the circumferential or axial fashion is a zone array Z filled with integrated values of the ratio of printing to non-printing area for the respective inking zones 40 on the printing plate 12. The number of accumulated samples of optical intensity are stored in a corresponding number-of-samples array NS. In an initial step 186 in the integration procedure, the zone array Z and number-of-samples array NS are cleared. In step 187 the cylinder or press drive 34 is turned on and the scanning occurs on an iterative basis upon the occurrence of resolver pulses sensed in step 188. The scanning circuits 32 in FIG. 3 generate a pulse or interrupt for each of a plurality of angular subdivisions of a single revolution of the plate cylinder 11, analgous to the steps of the stepper motor 21 (FIG. 7) for axial scanning. A resolver pulse indicates that the angle from the resolver 33 (FIG. 3) has changed by some predetermined amount. In step 189 the plate cylinder angle is read from the resolver 33 in order to determine whether the angle is within the clamping zone which should not be scanned by the scanner 15. In step 190 the clamping zone is sensed and if the angle is not the first angle in the clamping zone, then the iteration for the current resolver pulse is completed. Otherwise, if the angle is the first angle in the clamping zone, the scanner axial position is read in step 192 in order to increment the axial position or to terminate scanning. If the axial position is greater or equal to the current table coordinate as sensed in step 193, then fine scanning to the current table coordinate is completed. Otherwise, the scanner axial adjustment is incremented in step 194 and scanning for the current resolver pulse is finished.

If the angle is not in the clamping zone as sensed in step 190, then the optical intensity and the current axial position is received in step 195 in order to perform an integration. In step 196, the current zone index i is determine as a predefined function of axial position by comparing the current axial position to zone boundaries which are predetermined reference values for the particular printing machine 10. In step 197, the optical intensity is normalized to a value between zero and one by subtracting the sensed optical intensity from the maximum value of optical intensity and dividing the difference by the range of optical intensity between the maximum and minimum. The normalization step 197 could also include a compensating step, by calculation or table look-up, to correct the normalized value for any non-linear response of the optical scanner 15 or due to the fact that a given ratio of printing to non-printing area requires a disproportionate amount of ink for printing. The actual integration is performed in step 198 by accumulating the normalized intensity value in the respective element of the zone array Z, and also incrementing the number of samples in the corresponding element in the array NS. At the end of the circumferential fine scanning subroutine 180 the zone array Z will contain the total integrated value for each zone. The total value, however, must be normalized as in step 199 by dividing the integrated value for each zone by the number of samples integrated for each zone, before returning to the calling subroutine 86 in FIG. 17.

Figure 19:
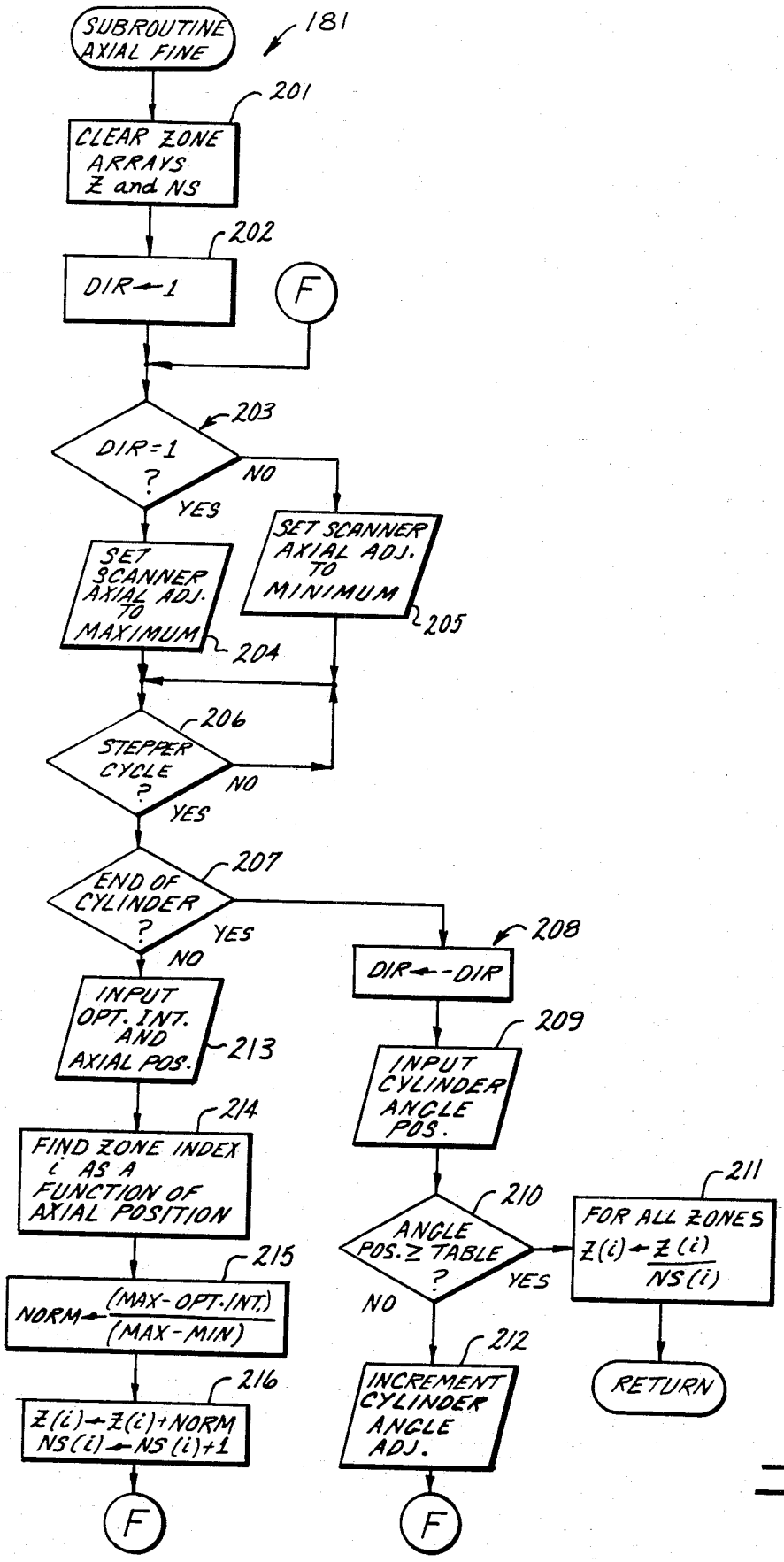
FIG. 19 is a flowchart of a subroutine which performs axial fine scanning.

Shown in FIG. 19 is a flowchart for the axial fine scanning subroutine 181 which is similar to the flowchart for the circumferential fine scanning subroutine 180 in FIG. 18. In the first step 201, the zone array Z and number-of-sample array NS are cleared. For axial scanning the scanner 15 is driven in both a forward and reverse direction. To indicate in which axial direction scanning is being performed, a direction flag DIR is used. In step 202 the direction flag DIR is set initially to one for scanning in the forward or positive axial direction. In step 203 the direction flag DIR is compared to one to determine whether the scanner 15 should be driven in a forward or reverse fashion. If the direction flag DIR is equal to one, then in step 204 the scanner axial adjustment is set to a maximum value so that the scanner 15 is driven in a forward direction. Otherwise, in step 205, the scanner axial adjustment is set to a minimum value to drive the scanner 15 in the reverse axial direction.

An optical intensity sample is accumulated for each stepper cycle. Hence, in step 206, the occurence of an individual stepper cycle is sensed. For each stepper cycle, the end of the cylinder 11 is first sensed in step 207. At the end of the cylinder, the direction flag DIR is inverted in step 208. In step 209, the cylinder angular position is sensed and compared in step 210 to the current table coordinate. If the angular position is greater or equal to the table coordinate, then integration is completed and execution returns to the calling subroutine 86 in FIG. 17 after the zone array Z is normalized in step 211. If, however, the angular position is less than the value of the table coordinate, then in step 212 the cylinder angular adjustment is incremented for another axial line of scanning across the plate 12.

If the end of the cylinder 11 was not sensed in step 207, then the optical intensity and axial position are determined in step 213 in order to accumulate the optical intensity. In step 214, the zone index i is found as a function of axial position in the same manner as described above in connection with step 196 of FIG. 18. Similarly, the optical intensity is normalized in step 215 and the normalized value is accumulated in step 216.

From the integrated and normalized values of printing to non-printing area for each inking zone 40, the desired ink key adjustments are obtained as a predetermined function of the integrated and normalized values. If the ink key positions do not match the respective ink key adjustments after a predetermined adjustment time, a warning signal is sent to the press operator. Otherwise, the register and ink key presetting operations are finished when the ink key positions are substantially equal to the ink key adjustments.

From the above a highly reliable system for reducing the setting-up time on a rotary printing machine has been described using a programmable numerical control computer and components for multi-functionally scanning any desired coordinates of the printing plates. A minimum input of desired values from the operator is required since the reference values for a particular machine are prestored in non-volatile memory. The reliability of the system is increased because the operator cannot enter incorrect reference values. The system does not require data processing external to the printing machine. Thus, there is no confusion as to which machine adjustments are to be transferred or directed. Moreover, the scanning process for determining the ink dosing presets is accelerated by operator entry of coordinates of the printing areas on the printing plate. The numerical computer is easily reprogrammed and the optical scanner is interchangeable with a densitometer in order to provide alternative control functions during printing, such as the regulation of inking and dampening.

What is claimed is:

1. In a rotary printing machine having a printing plate mounted on a plate cylinder, a machine frame to which the plate cylinder is journaled, a drive for rotating the plate cylinder, automatic means for adjusting the axial and circumferential register of the plate cylinder, and automatic means for dosing a desired amount of ink to a plurality of axially-displaced inking zones on the printing plate, an apparatus for presetting the axial and circumferential register and the means for zonally dosing ink comprising, in combination, means for sensing the angular position of the plate cylinder drive, an optical scanner and traversing mechanism mounted to the machine frame for axial scanning of the printing plate including means for driving the optical scanner to a commanded axial position, and a numerical computer including memory, being responsive to the angular position of the plate cylinder drive, the axial position of the optical scanner, and a signal from the optical scanner, and having means to selectively operate the machine drive, move the optical scanner to commanded axial positions, and generate control signals for said means for adjusting axial and circumferential register and said means for dosing ink, said numerical computer further comprising (a) means for sensing the axial and circumferential positions with respect to the machine frame and machine drive, respectively, of at least one register mark engraved on the printing plate, (b) means for adjusting the axial and circumferential positions of the register mark so that the register mark is aligned with predetermined axial and circumferential positions, and (c) means for scanning printing areas on the printing plate and determining ink dosing control signals responsive to the ratio of printing to non-printing area in the respective inking zones on the printing plate, so that a single optical scanner multi-functionally scans the printing plate to preset the register and zonal ink dosing within the printing machine under control of the numerical computer.

2. The combination as claimed in claim 1 further comprising means for driving the scanner at a selected plurality of predetermined speeds.

3. The combination as claimed in claim 2 further comprising means for receiving positions of printing regions on the printing plate, and wherein the numerical computer comprises means responsive to the received positions for driving the scanner at a slower one of said predetermined speeds to scan said printing regions and at a faster one of said predetermined speeds to traverse between said printing regions.

4. The combination as claimed in claim 3, wherein the means for receiving the positions of printing regions on the printing plate comprise means for receiving coordinates for coarse zones without printing regions and fine zones including printing regions, wherein the combination further comprises means for operator selection of either circumferential or axial scanning, and wherein the means for scanning further comprise means for scanning the printing plate in either a circumferential or axial scanning fashion in response to the selection by the operator.

5. The combination as claimed in claim 1, wherein said means for sensing the angular position of the plate cylinder drive is an angle resolver.

6. The combination as claimed in claim 1, wherein said numerical computer is mounted on the machine frame so that the control signals for the register adjustment and ink dosing are transmitted inside the printing machine from the numerical computer directly to the means for adjusting register and ink dosing.

7. The combination as claimed in claim 1, wherein the traversing mechanism comprises a rail parallel to the plate cylinder axis and a slide driven by at least one stepper motor to traverse the axial rail.

8. The combination as claimed in claim 7, wherein the optical scanner is interchangeably connected to the slide through a bayonet mount.

9. The combination as claimed in claim 1, wherein the optical scanner is interchangeably connected to the traversing mechanism through a bayonet mount.

10. The combination as claimed in claim 9, wherein the bayonet mount accepts a densitometer, interchangeable with the optical scanner, for sensing ink and dampening solution during continuous printing.

11. The combination as claimed in claim 1, wherein the volatile random access memory locations in the numerical computer are eraseable after each presetting operation.

12. A method of operating a numerical computer having a memory for the presetting of a rotary printing machine having a printing plate mounted on a plate cylinder, a machine frame to which the plate cylinder is journaled, a drive for rotating the plate cylinder, automatic means for adjusting the axial and circumferential register of the plate cylinder, automatic means for dosing a desired amount of ink to a plurality of axially displaced inking zones on the printing plate, means for sensing the angular position of the plate cylinder drive, and an optical scanner and traversing mechanism mounted to the machine frame for axial scanning of the printing plate including means for driving the optical scanner to a commanded axial position, said computer being responsive to the angular position of the plate cylinder drive, the axial position of the optical scanner, and a signal from the optical scanner, and having means to selectively operate the machine drive, move the optical scanner to commanded axial positions, and generate control signals for said means for adjusting axial and circumferential register and means for dosing ink, said method comprising the steps of:

(a) moving the optical scanner to the predetermined location of at least one register mark engraved on said printing plate, and thereupon correlating a signal from said optical scanner with the angular position of the plate cylinder drive and the axial position of the optical scanner to determine the axial and circumferential positions of said register mark engraved on said printing plate, (b) generating control signals for said means for adjusting axial and circumferential register in response to the determined axial and circumferential positions of said register mark so that the register mark is aligned with predetermined axial and circumferential positions, and (c) moving said optical scanner to the locations of printing areas on the printing plate and at said locations moving said optical scanner and operating said machine drive to scan the printing areas, and processing said signal from said optical scanner to determine ink dosing control signals responsive to the ratio of printing to non-printing area in respective inking zones on the printing plate, so that a single optical scanner multi-functionally scans the printing plate to preset the register and zonal ink dosing within the printing machine under control of the numerical computer.

13. The method as claimed in claim 12, wherein said means for driving the optical scanner includes means for driving the scanner at a selected plurality of predetermined speeds in response to a speed control signal, and said step (c) of moving said optical scanner to predetermined locations of printing areas on the printing plate includes the steps of generating said speed control signal for driving the scanner at a slower one of said predetermined speeds to scan said printing regions and at a faster one of said predetermined speeds to traverse between said printing regions.

14. The method as claimed in claim 13, wherein said computer is responsive to means for operator selection of either circumferential or axial scanning and operator entry of coordinates for coarse zones without printing regions and fine zones including printing regions, and wherein said step (c) of moving said optical scanner to the locations of printing areas on the printing plate includes a preliminary step of determining the locations of the printing areas in response to the operator selection of scanning and operator entry of zone coordinates, and said step of moving said optical scanner and operating said machine drive to scan the printing areas includes selectively scanning in either circumferential or axial scanning fashion in response to the scanning selection by the operator.

* * * * *